US005927159A

United States Patent [19]

Yokoyama et al.

[11] Patent Number: 5,927,159

[45] Date of Patent: Jul. 27, 1999

[54] RATCHET WRENCH

[75] Inventors: Takashi Yokoyama; Akihiro Yamakado, both of Tsu, Japan

[73] Assignee: MCC Corporation, Tsu, Japan

[21] Appl. No.: 08/877,811

[22] Filed: Jun. 18, 1997

[30] Foreign Application Priority Data

Jun. 18, 1996 [JP] Japan ..... 8-156586

[51] Int. Cl.[6] ..... B25B 13/00; B25B 13/28

[52] U.S. Cl. ..... 81/99; 81/94; 81/92; 81/111

[58] Field of Search ..... 81/92, 99, 94, 81/100, 101, 103, 106, 109, 111

[56] References Cited

U.S. PATENT DOCUMENTS

| | | | |
|---|---|---|---|
| 0,561,274 | 6/1896 | Palmer | 81/101 |
| 1,454,016 | 5/1923 | Steen | 81/101 |
| 2,198,951 | 4/1940 | Roush et al. . | |
| 2,528,814 | 11/1950 | Boyer | 81/91 |
| 2,708,384 | 5/1955 | Mann . | |
| 2,800,045 | 7/1957 | Mann | 81/91 |
| 4,913,011 | 4/1990 | Ma | 81/90.1 |

*Primary Examiner*—David A. Scherbel
*Assistant Examiner*—Shantese McDonald
*Attorney, Agent, or Firm*—Wenderoth, Lind & Ponack, L.L.P.

[57] ABSTRACT

A ratchet wrench including a fixed jaw and a movable jaw attached to a body of the ratchet wrench and having V-shaped nut gripping portions opposing each other. The fixed jaw is pivoted to a forward end portion of the body and biased to rotate toward the movable jaw by a spring. An adjusting nut is provided rotatably about a longitudinal center axis of the body, and an adjusting screw rod is threaded into the adjusting nut so that it is movable back and forth along the longitudinal center axis of the body by rotating the adjusting nut in one direction or the other. The movable jaw is pivoted at a rear end portion thereof to the adjusting screw rod by a guide pin which is guided along a longitudinal slot provided in the body and, the movable jaw is biased to rotate toward the fixed jaw by a spring provided between the movable jaw and the adjusting screw rod. A pivot point between the movable jaw and the adjusting screw rod is positioned on a straight line passing through apexes of the V-shaped nut gripping portions of the movable jaw and the fixed jaw upon gripping a nut therebetween.

8 Claims, 7 Drawing Sheets

RATCHET WRENCH

BACKGROUND OF THE INVENTION

The present invention relates to a ratchet wrench suitable for rotating a mechanical joint used in gas pipings, water supply pipings, hot water supply pipings, hydraulic pipings and the like.

A ratchet wrench is a tool in which a pair of fixed and movable jaws having opposed V-shaped nut gripping portions are mounted on a body, and a nut is tightened by fitting the nut between the laws and by rotating the body downwardly, and, when the body is returned upwardly, the movable jaw is automatically opened to idly rotate the wrench itself with respect to the nut.

In such a ratchet wrench, the nut is securely held only when the fixed jaw and the movable jaw are completely closed relative to each other. Thus, in the past, various ratchet wrenches for respective sizes of nuts have been required. To obviate the need for such plural wrenches, the inventors have proposed a ratchet wrench in which a movable jaw is steppingly advanced and retracted by utilizing an eccentric pin so that the single ratchet wrench can cope with nuts of various sizes, as disclosed in Japanese Utility Model Publication No. 2-36700 (1990).

However, the conventional ratchet wrenches including those designed for a nut of a particular size and those which can be steppingly advanced and retracted have a disadvantage that during tightening the nut may be damaged. That is to say, in a ratchet wrench, a space (mouth width) for gripping the nut is set to have a positive tolerance with respect to a reference size of the nut, or oppositely the nut is set to have a negative tolerance. Thus, when the ratchet wrench is rotated while gripping the nut, a gap corresponding to the tolerance is created in the nut gripping portions, with the result that the nut gripping portions are line contacted with edge lines of the nut, thereby damaging the nut.

To avoid such drawbacks of conventional ratchet wrenches stated above, a ratchet wrench which is capable of steplessly or continuously adjusting a space between a movable jaw and a fixed jaw has been proposed which is, for example as shown in U.S. Pat. No. 2,800,045.

FIG. 7 shows an example of such a proposed ratchet wrench. In the figure, a handle 9 is provided with an enlarged hub portion 10 which is integral with an enlarged bearing portion 11, the bearing portion 11 is slotted at 12 in order to rotatably support a knurled threaded nut 13 therein, and a threaded support 31 is threaded into the knurled threaded nut 13. An outer jaw or a movable jaw 20 is pivoted at 23 to the threaded support 31 and an inner jaw or a fixed jaw 15 is pivoted at 17 to the forward end portion of the body 10. By rotating the knurled nut 13 in one direction or the other, the threaded support 31 and the movable jaw 20 connected thereto are advanced or retracted whereby the gap between the movable jaw 20 and the fixed jaw 15 can be steplessly adjusted to be fitted on a nut N to be tightened.

In this conventional ratchet wrench, however, as shown, the pivot point 23 between the movable jaw 20 and the threaded support 31 is out of a horizontal axial line L2 passing through the apexes of both V-shaped nut gripping portions 21, 19 of the movable jaw 20 and the fixed jaw 15, and a straight line L1 connecting between the pivot point 23 and the apex of V-shaped nut gripping portion 21 of the movable jaw forms an angle θ relative to the horizontal axial line L2.

Thus, when the nut is tightened by the wrench, as shown, a reaction force R from the nut N is applied to the movable jaw 20 and this reaction force R is dissolved into two component forces R1 and R2, wherein R1 is a component force which is parallel to the line L1, and R2 a component force which is perpendicular to the line L1. However, since this component force R2 contributes to rotation of the movable jaw 20 in a clockwise direction about the pivot point 23, it tends to open the movable jaw 20 relative to the fixed jaw 15. Thus, the conventional ratchet wrench as shown has a drawback in that the movable jaw 20 tends to become disengaged from the nut N during a tightening operation thereof. In addition, since a fraction of a moment applied to the handle 9 for tightening the nut is wasted as a component force for disengaging the wrench from the nut, the moment applied to the handle can not be effectively used for a tightening operation.

These disadvantages are enhanced by the fact that the pivot point 17 between the fixed jaw 15 and the forward end portion of the handle 9 is out of the line L2. Namely, due to the same reasons as stated above, the reaction force R' applied to the fixed jaw 15 from the nut 4 is dissolved into two component forces R1' and R2' and the component force R2' tends to rotate the fixed jaw 15 clockwisely about the pivot point 17, which pushes the movable jaw 20 upwardly. Therefore, the movable jaw 20 is further forced to disengage from the nut being tightened.

In addition, in the conventional ratchet wrench shown in FIG. 7, since the threaded support 31 is bulky and projects out of the body 10, the overall size of the wrench is large and there is a danger of the threaded support 31 being damaged by rough use of the wrench. Further, since the springs 25 and 33 for urging the movable jaw 20 and the fixed jaw 15 to close toward each other are leaf springs and are provided outside the body of the ratchet wrench, the size of the springs is relatively large and not only is damage to the springs possible when the wrench is handled roughly, but also the appearance of the wrench is spoiled.

The present invention was made to solve the above-mentioned conventional drawbacks, and an object of the present invention is to provide a ratchet wrench which is capable of rotating nuts having a variety of sizes while maintaining face-contact with the nut, and without damaging the nut.

Another object of the present invention is to provide a ratchet wrench which presents no danger of disengaging the ratchet wrench from the nut during a tightening operation, thereby, enabling a tightening operation to be effected safely and securely.

A further object of the present invention is to provide a ratchet wrench wherein the moment applied to the handle is effectively used for tightening a nut.

A still further object of the present invention is to provide a ratchet wrench wherein the overall size is compact.

SUMMARY OF THE INVENTION

According to a first aspect of the invention, a ratchet wrench of the invention comprises a fixed jaw and a movable jaw attached to a body of the ratchet wrench and having V-shaped nut gripping portions opposing each other. The fixed jaw is pivoted to a forward end portion of the body and biased to rotate toward the movable jaw by a spring. An adjusting nut is provided rotatably about a longitudinal center axis of the body, and an adjusting screw rod is threaded into the adjusting nut so that it is movable back and forth along the longitudinal center axis of the body by rotating the adjusting nut in one direction or the other. The movable jaw is pivoted at a rear end portion thereof to the adjusting screw rod by a guide pin which is guided along a longitudinal slot provided in the body. The movable jaw is biased to rotate toward the fixed jaw by a spring provided between the movable jaw and the adjusting screw rod. A pivot point between the movable jaw and the adjusting screw rod is positioned on a straight line passing through apexes of the V-shaped nut gripping portions of the movable jaw and the fixed jaw upon gripping a nut therebetween.

According to a ratchet wrench of the invention as arranged above, since a space between the movable jaw and the fixed jaw can be steplessly adjusted, a nut of any size can be gripped between the movable jaw and the fixed jaw without any gap and can be rotated while maintaining surface contact, so that nuts of a variety sizes can be tightened without any damage thereto. Also, since the spring is connected between the movable jaw and the adjusting screw rod, even if the movable jaw is advanced or retracted to adjust the nut gripping space, the spring force for gripping the nut is constant and, therefore, the nut can be held securely under a constant force. Further, since no component of force tending to disengage the movable jaw from the nut is generated in the movable jaw during tightening of the nut, a tightening operation can be effected safely and positively. In addition, since no component of force which tends to disengage the movable jaw from the nut is generated, a moment applied to the handle is effectively used to tighten the nut.

A pivot point between the fixed jaw and the forward end portion of the body is preferably disposed on a straight line passing through the apexes of the V-shaped nut gripping portions of the movable jaw and the fixed jaw, whereby no additional force to disengage the movable jaw from the nut is generated in the fixed jaw.

In this invention, the body is preferably constituted as a hollow construction and the adjusting screw rod and the springs for biasing the movable jaw and the fixed jaw toward each other are fully disposed in the hollow body. By this arrangement, the overall size is made compact and there is no danger of the elements of the ratchet wrench being damaged during use thereof.

The above and other objects, features and advantages of the present invention will become more apparent from the following description when taken in conjunction with the accompanying drawings, in which a preferred embodiment of the present invention is shown by way of illustrative example.

PREFERRED EMBODIMENT OF THE INVENTION

The present invention will now be fully explained in connection with an embodiment thereof with reference to the accompanying drawings.

Figure 1:
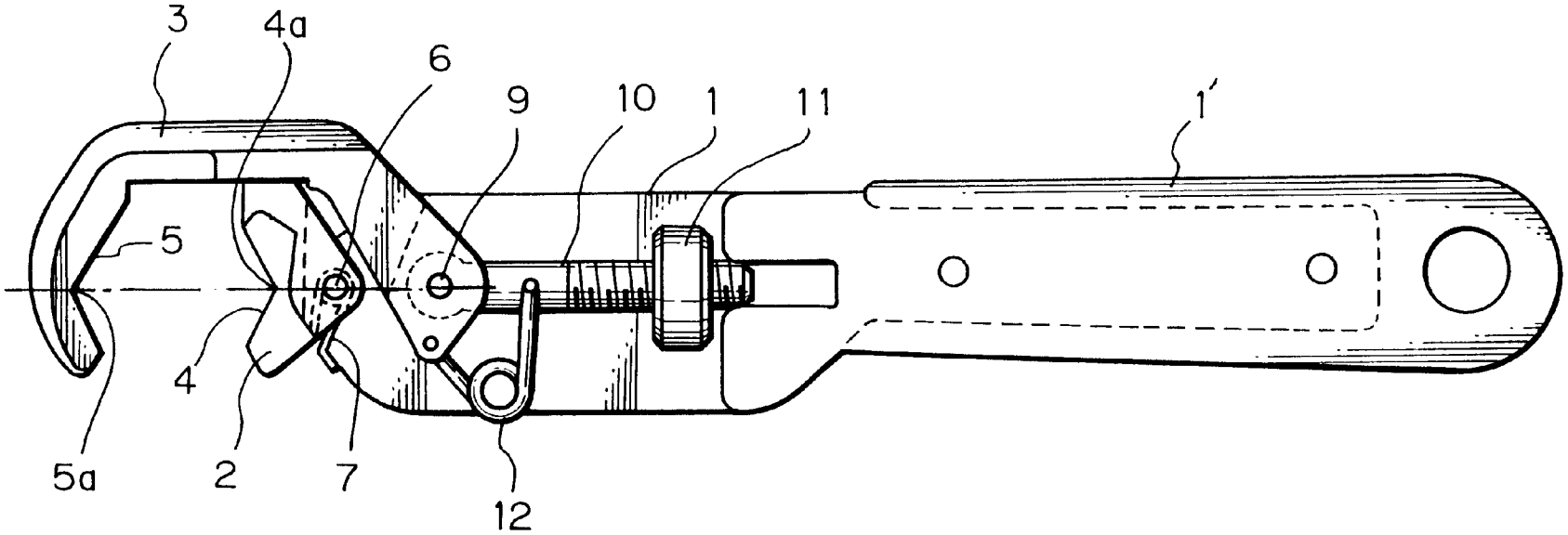
FIG. 1 is a front view of a ratchet wrench according to the present invention, with a cover removed.
Figure 2:
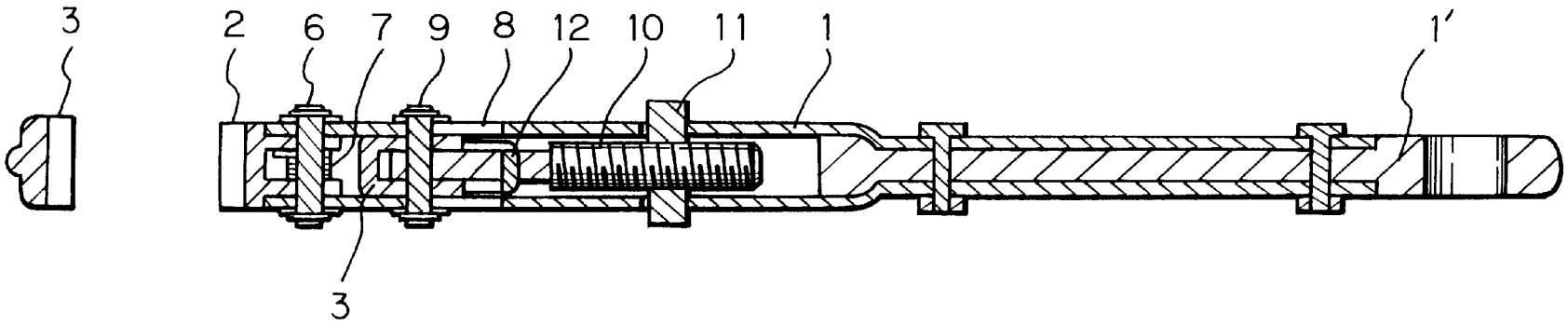
FIG. 2 is a longitudinal sectional view of the ratchet wrench according to the present invention.

FIG. 1 is a front view of a ratchet wrench according to the present invention, with a cover being removed, and FIG. 2 is a longitudinal sectional view of the ratchet wrench.

In FIGS. 1 and 2, a ratchet wrench comprises a body 1 having a central hollow portion or bore, a fixed jaw 2, and a movable jaw 3 disposed forwardly of the fixed jaw 2. The body 1 is fixed to a handle 1' by pins or other suitable means. The fixed jaw 2 and the movable jaw 3 are provided at their inner surfaces with opposing V-shaped nut gripping portions 4 and 5, respectively. The fixed jaw 2 is rotatably mounted on a front end portion of the body 1 by a pin 6 and is always biased toward the movable jaw 3 by a spring 7.

Figure 3:
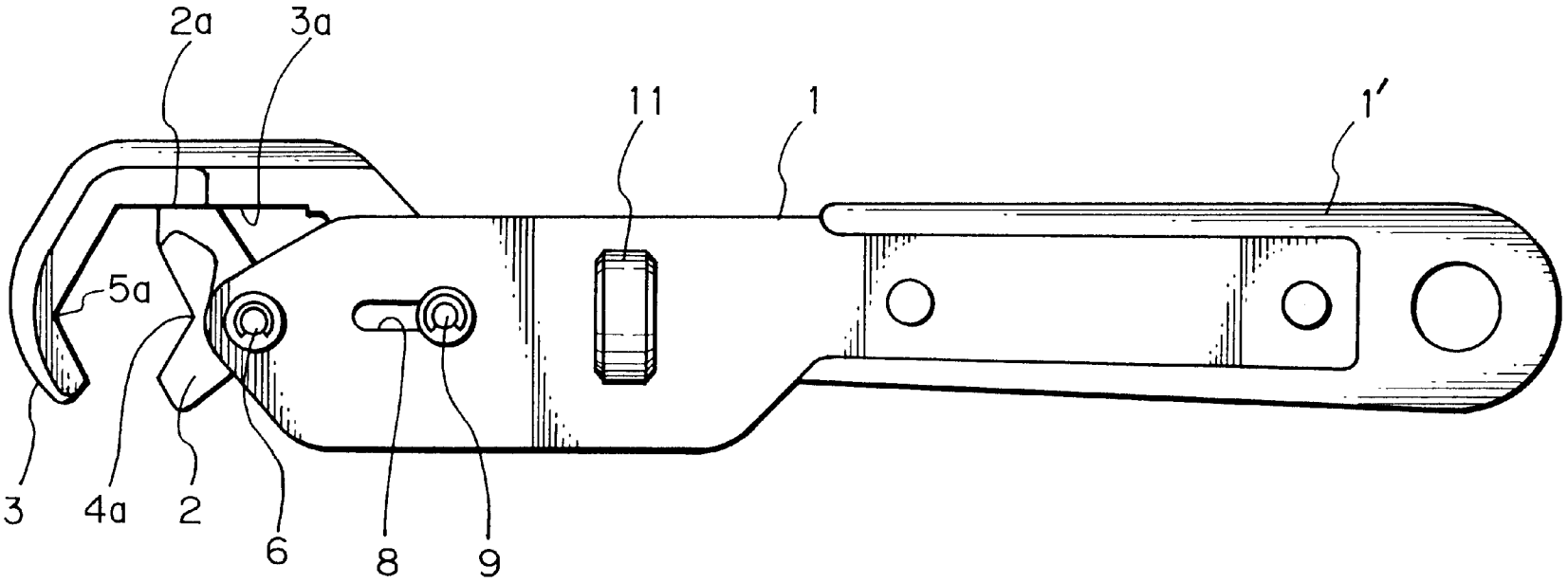
FIG. 3 is a front view showing a condition that a movable jaw of the ratchet wrench is retracted.

A rear end portion of the movable jaw 3 is pivotally connected to a front end portion of an adjusting screw rod 10 disposed within the body 1 by a guide pin 9, which is guided within longitudinal central slots 8 formed in both sides of the body 1. A male threaded portion of the adjusting screw rod 10 is threaded into an adjusting nut 11. Since the adjusting nut 11 is exposed to the outside through windows formed in the body 1, the adjusting screw 10 and accordingly the movable jaw 3 connected thereto can be advanced and retracted in a stepless manner in a longitudinal direction of the body 1 by rotating the adjusting nut 11 in one direction or the other. FIG. 3 shows a condition wherein the movable jaw 3 is retracted. A spring 12 for biasing the movable jaw 3 toward the fixed jaw 2 is disposed between the rear end portion of the movable jaw 3 and the adjusting screw rod 10.

A straight surface 3*a* of the movable jaw 3 engages with a straight surface 2*a* of the fixed jaw 2 for sliding movement therebetween as shown in FIG. 3. The spring 12 is stronger than the spring 7. Thus, the fixed jaw 2 is normally biased in a counterclockwise direction by the movable jaw 3 against the force of the spring 7. The rotation of the fixed jaw 2 and, thus, the movable jaw 3 in the counterclockwise direction is limited at the position shown in FIG. 1 or 3 by the engagement between the fixed jaw 2 and a stopper pin (not shown) provided in the body 1.

In the ratchet wrench according to the present invention, as shown in FIG. 3, apexes 4*a*, 5*a* of the "V" of each of the nut gripping portions 4, 5 of the fixed and movable jaws 2, 3 are disposed on a line parallel with a moving direction (advancing/retracting direction) of the movable jaw 3. Thus, when the movable jaw 3 is advanced or retracted in a stepless manner, the opposed V-shaped nut gripping portions 4, 5 can be opened or closed without changing their angles.

Figure 4:
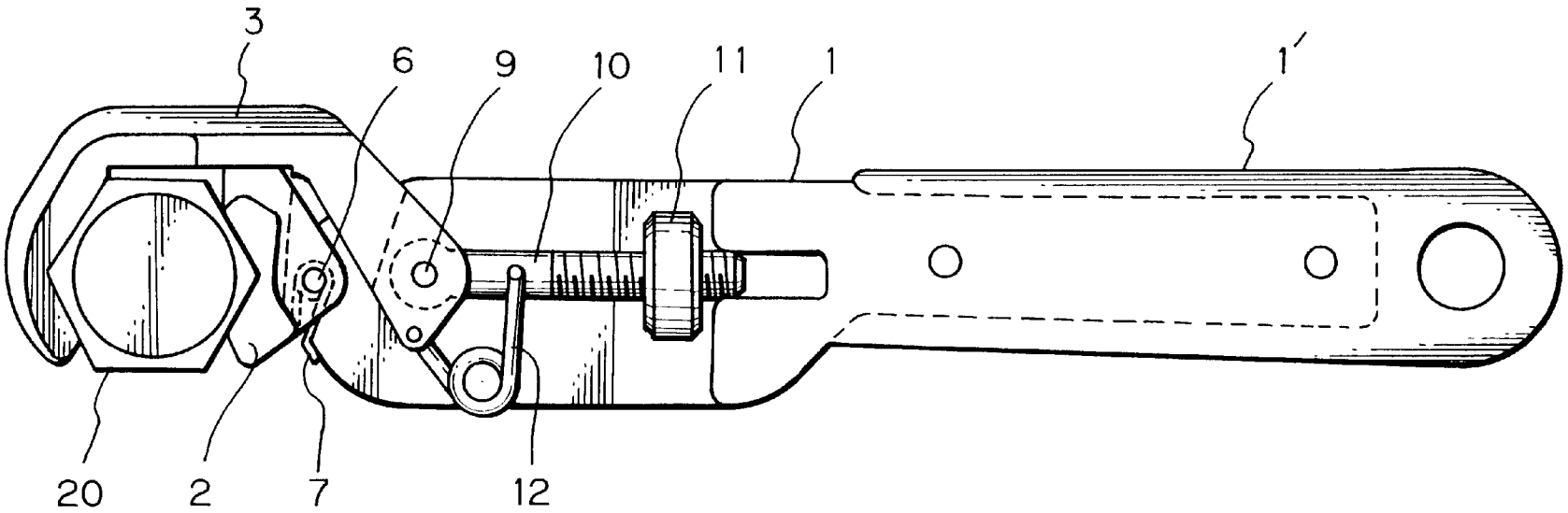
FIG. 4 is a front view showing a condition that a nut is gripped by the ratchet wrench.
Figure 5:
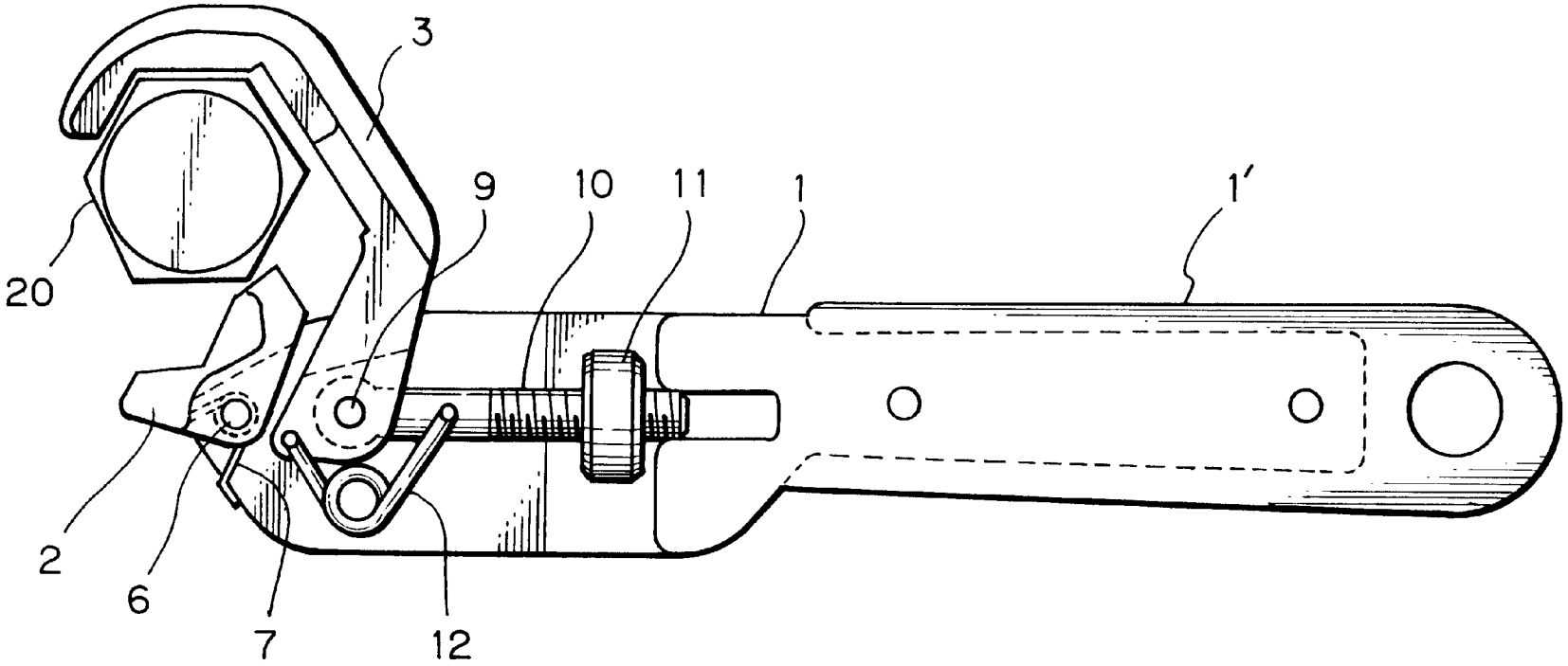
FIG. 5 is a front view showing a condition that the movable jaw is opened.

According to the present invention, with the arrangement as mentioned above, when a nut 20 is tightened by using the ratchet wrench, as shown in FIG. 5, the movable jaw 3 is opened greatly in opposition to the spring 12 and the movable jaw 3 is engaged by the nut 20 to be rotated. In this case, the fixed jaw 2 is biased upwardly by the spring 7 so that the fixed jaw does not interfere with the nut 20 when the nut is received between the V-shaped nut gripping portions 4, 5. From this condition, when the handle 1' is rotated downwardly, as shown in FIG. 4, the movable jaw 3 is closed against the fixed jaw 2, with the result that the nut is pinched between the nut gripping portions 4, 5.

In this condition, if there is any gap between the nut gripping portions 4, 5, the adjusting screw rod 10 and the movable jaw 3 are retracted in a stepless manner by rotating the adjusting nut 11 to eliminate the gap. In this case, as mentioned above, since the apexes 4*a*, 5*a* of the nut gripping portions 4, 5 are arranged on the line parallel with the moving direction of the movable jaw 3 so that the V-shaped nut gripping portions 4, 5 can be opened and closed without changing their angles, the V-shaped nut gripping portions 4, 5 can be closely face-contacted with the nut 20 regardless of a size of the nut 20.

Then, by alternately rotating the body 1 upwardly and downwardly, the nut 20 is rotated while being pinched between the nut gripping portions 4, 5. According to the present invention, unlike in conventional ratchet wrenches, since the nut 20 is rotated without any gap between the nut and the nut gripping portions, the nut 20 is not damaged. Further, since the spring 12 for biasing the movable jaw 3 is disposed between the movable jaw 3 and the adjusting screw rod 10, even when the movable jaw 3 is advanced or retracted together with the adjusting screw rod 10, the force of the spring 12 biasing the movable jaw 3 is constant or uniform. Thus, unlike a conventional ratchet wrench in which one end of the spring is attached to the body, even when the size of the nut is changed, a force for holding the nut 20 is unchanged. Further, in the conventional ratchet wrench in which one end of the spring is attached to the body, when the movable jaw 3 is advanced, the repelling force of the spring resists against the movement of the movable jaw; whereas, in the present invention, when the movable jaw 3 is advanced, since the repelling force of the spring 12 does not act on the movable jaw, the movable jaw 3 can easily be advanced and retracted.

Figure 6:
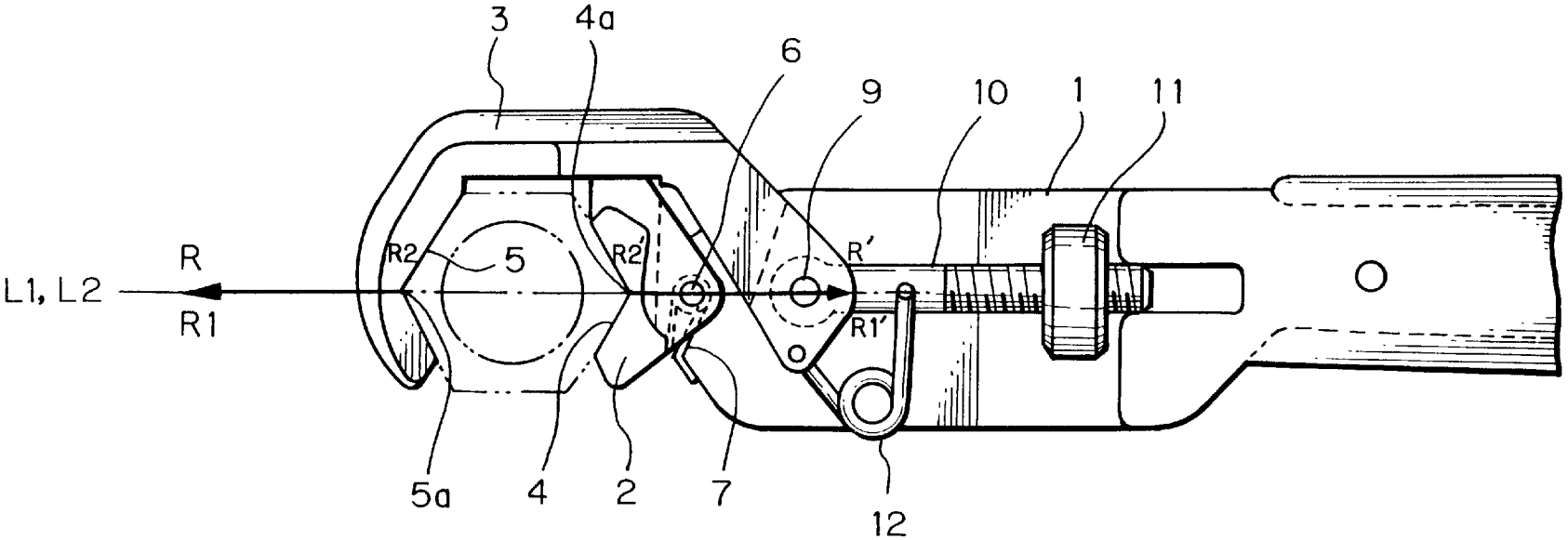
FIG. 6 is a front view including a diagram showing reaction forces generated in the fixed jaw and the movable jaw upon tightening a nut by the ratchet wrench of the invention.

FIG. 6 is a diagram showing reaction forces applied to the fixed jaw 2 and the movable jaw 3 from a nut upon tightening the nut by the ratchet wrench of the invention.

Figure 7:
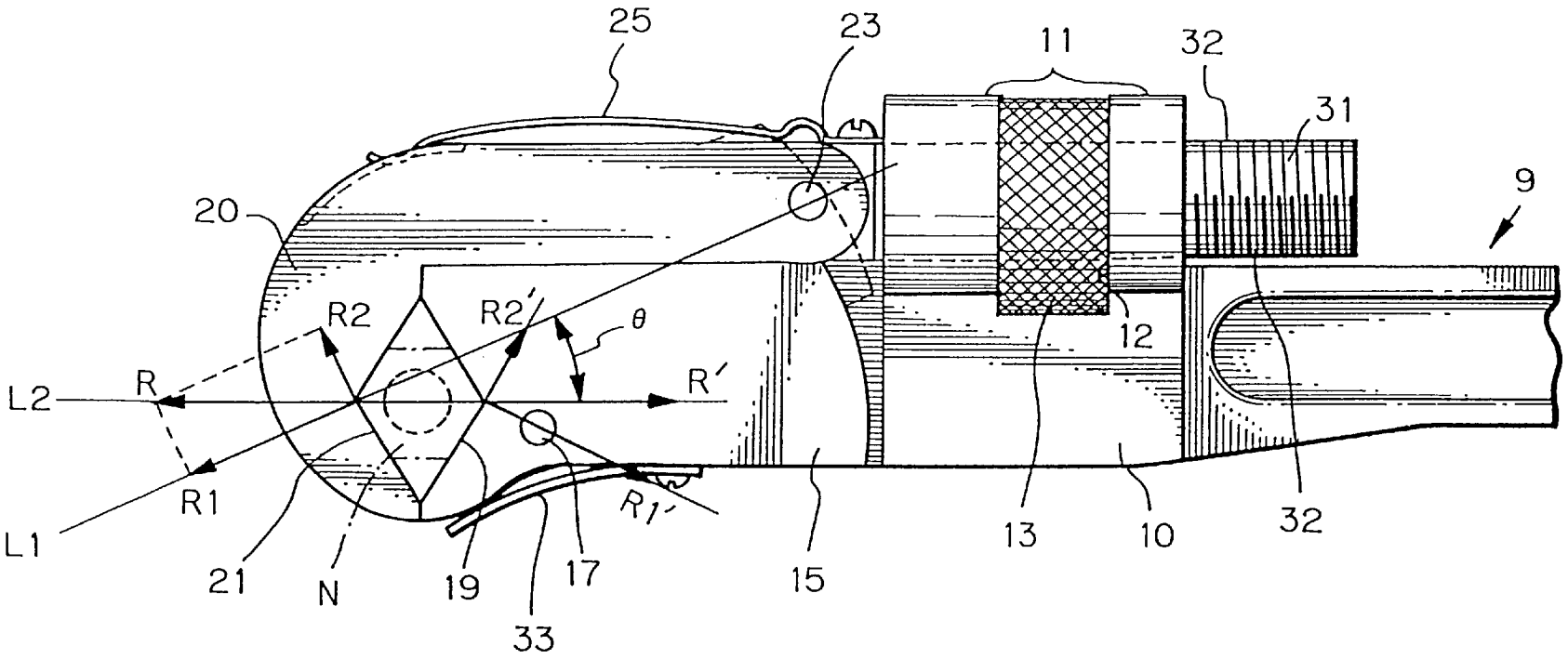
Fig. 7 PRIOR ART
FIG. 7 is a front view of a conventional ratchet wrench showing reaction forces generated in the fixed jaw and the movable jaw upon tightening a nut.

In the embodiment shown, since the pivot point 9 between the movable jaw 3 and the adjusting screw rod 10 is positioned on the straight line L2 connecting the apexes 4*a*, 5*a* of the nut gripping portions 4, 5 of the movable jaw 5 and the fixed jaw 2, the reaction force R applied to the movable jaw 5 from the nut 4 is parallel to the line L2 and no force component R2 perpendicular to the line L2 is applied to the movable jaw 3. Thus, unlike the prior art ratchet wrench shown in FIG. 7, no component of force which tends to open the movable jaw 3 relative to the nut 4 is applied to the movable jaw 3.

Also, since the pivot point 6 between the fixed jaw 2 and the body 1 is positioned on the line L2, the reaction force R' applied to the fixed jaw 2 from the nut is parallel to the line L2 and no force component R2' perpendicular to the line L2 is generated in the fixed jaw 2. Accordingly, no component of force which tends to rotate the fixed jaw 2 clockwise is generated and, therefore, no additional force which tends to disengage the movable jaw 3 from the nut is generated.

Accordingly, there is no danger of disengaging the ratchet wrench from the nut upon tightening and, therefore, the tightening operation can be effected safely and securely. In addition, the moment applied to the handle is effectively used for tightening the nut.

Also, as shown in FIG. 2, since the wrench body 1 is formed as a hollow construction and the screw rod 10 is fully disposed within the body 1, the overall size of the wrench can be made compact.

In addition, since the spring 12 which urges the movable jaw 2 toward the fixed jaw 3 and the spring 7 which urges the fixed jaw 2 toward the movable jaw 3 are coil springs, they can be made relatively compact and can be fully disposed in the wrench body 1. Accordingly, the overall appearance of the wrench can be made neat and there is no risk of the springs being damaged even if the wrench is handled roughly.

As mentioned above, in the ratchet wrench according to the present invention, a gripping space can be adjusted in a stepless manner and nuts having various sizes can be rotated while maintaining face-contact and without damaging the nuts. Further, even when the movable jaw is advanced or retracted, since the spring force for gripping the nut does not change, the nut is gripped with a constant and stable force.

Further, since there is no component of force tending to disengage the ratchet wrench from a nut during the tightening operation, the tightening operation can be effected safely and securely and the moment applied to the handle is effectively used for tightening the nut. In addition, since the wrench body is constituted as a hollow construction and wrench elements such as the adjusting screw rod and the jaw biasing springs are fully disposed in the wrench body, the overall size is made compact and there is no danger of the elements being damaged even if the wrench is used roughly.

What is claimed is:

1. A ratchet wrench comprising a fixed jaw and a movable jaw attached to a body of said ratchet wrench and having V-shaped nut gripping portions opposing each other, said fixed jaw being pivoted to a forward end portion of said body and biased to rotate toward said movable jaw by a spring means, an adjusting nut rotatably provided about the longitudinal center axis of said body, an adjusting screw rod threaded into said adjusting nut and movable back and forth along said longitudinal center axis of said body by rotating said adjusting nut in one direction or the other, said movable jaw being pivoted at rear end portion thereof to said adjusting screw rod by a guide pin which is guided along a longitudinal slot provided in said body, said movable jaw being biased to rotate toward said fixed jaw by a spring means provided between said movable jaw and said adjusting screw rod, a pivot point between said movable jaw and said adjusting screw rod being positioned on a straight line passing through apexes of said V-shaped nut gripping portions of said movable jaw and said fixed jaw upon gripping a nut therebetween.

2. A ratchet wrench claimed in claim 1, wherein said body is constituted as a hollow construction and said adjusting screw rod is fully disposed within said body, and said adjusting nut reveals out of said body through windows provided on both sides of said body.

3. A ratchet wrench claimed in claim 2, wherein said pivot point between said fixed jaw and said forward end portion of said body is disposed on said straight line passing through apexes of said V-shaped nut gripping portions of said movable jaw and said fixed jaw.

4. A ratchet wrench claimed in claim 2, wherein said spring means provided between said fixed jaw and said forward end portion of said body is a coil spring and is provided within said body around said pivot point between said fixed jaw and said forward portion of said body.

5. A ratchet wrench claimed in claim 2, wherein said spring means provided between said movable jaw and said adjusting screw rod is a coil spring provided within said body.

6. A ratchet wrench claimed in claim 1, wherein said pivot point between said fixed jaw and said forward end portion of said body is disposed on said straight line passing through apexes of said V-shaped nut gripping portions of said movable jaw and said fixed jaw.

7. A ratchet wrench claimed in claim 1, wherein said spring means provided between said fixed jaw and said forward end portion of said body is a coil spring and is provided within said body around said spring and is provided within said body around said pivot point between said fixed jaw and said forward portion of said body.

8. A ratchet wrench claimed in claim 1, wherein said spring means provided between said movable jaw and said adjusting screw rod is a coil spring provided within said body.

* * * * *